US008764112B2

(12) United States Patent
Fischer

(10) Patent No.: US 8,764,112 B2
(45) Date of Patent: Jul. 1, 2014

(54) SEATING FURNITURE AND FITTING FOR SAME

(75) Inventor: Matthias Fischer, Bratislava (SK)

(73) Assignee: Kintec-Solution GmbH, Rietberg (DE)

( * ) Notice: Subject to any disclaimer, the term of this patent is extended or adjusted under 35 U.S.C. 154(b) by 183 days.

(21) Appl. No.: 13/564,293

(22) Filed: Aug. 1, 2012

(65) Prior Publication Data

US 2013/0169018 A1 Jul. 4, 2013

(30) Foreign Application Priority Data

Dec. 28, 2011 (EP) ..... 11195967

(51) Int. Cl.
*A47C 7/50* (2006.01)

(52) U.S. Cl.
USPC ..... 297/423.19

(58) Field of Classification Search
USPC ..... 297/68, 83, 84, 88, 423.19, 423.2, 297/423.22, 423.26, 423.28
See application file for complete search history.

(56) References Cited

U.S. PATENT DOCUMENTS

| | | | | |
|---|---|---|---|---|
| 1,984,281 | A * | 12/1934 | Poggendorf | 297/317 |
| 2,484,803 | A * | 10/1949 | Bell et al. | 297/423.22 |
| 2,903,045 | A | 9/1959 | Viall | |
| 3,016,265 | A * | 1/1962 | Cobb | 297/88 |
| 3,068,047 | A * | 12/1962 | Schliephacke | 297/88 |
| 3,101,216 | A * | 8/1963 | Schliephacke | 297/88 |
| 3,429,612 | A * | 2/1969 | Cobb | 297/75 |
| 6,036,268 | A * | 3/2000 | Larson | 297/423.26 |
| 6,692,078 | B2 * | 2/2004 | Pham et al. | 297/423.2 |
| 7,080,887 | B2 * | 7/2006 | Tseng | 297/423.19 |
| 2008/0018157 | A1 | 1/2008 | Dewert | |
| 2011/0043005 | A1 | 2/2011 | Fischer | |
| 2013/0169018 | A1 | 7/2013 | Fischer | |

FOREIGN PATENT DOCUMENTS

| | | | |
|---|---|---|---|
| BE | 1009147 | A3 | 12/1996 |
| CN | 102871397 | A | 1/2013 |

(Continued)

OTHER PUBLICATIONS

Form PCT/ISA/220 Notification of Transmittal of International Search Report dated Jan. 16, 2013 (1 page).

(Continued)

*Primary Examiner* — Philip Gabler
(74) *Attorney, Agent, or Firm* — Flynn, Thiel, Boutell & Tanis, P.C.

(57) ABSTRACT

Seating furniture including a base fixed in position during use, a seat unit with a seat surface, and a leg unit moveable in relation to the seat unit and having a leg support surface. The leg unit is displaceable by a movement mechanism between a storage position and a use position. The movement mechanism transfers the leg unit from the storage position into the use position, and has an intermediate support displaceable in relation to the seat unit or the base by a pivoting guide. The pivoting guide has a first pivot lever between the intermediate support and the seat unit or the base, and the movement mechanism has a sliding guide with a sliding member guided in a translatory manner on the intermediate support, and the leg unit is attached to the sliding member.

15 Claims, 3 Drawing Sheets

(56) References Cited

FOREIGN PATENT DOCUMENTS

| | | | |
|---|---|---|---|
| DE | 28 47 875 | B1 | 10/1979 |
| DE | 37 18 645 | A1 | 3/1988 |
| DE | 295 01 078.9 | U1 | 4/1995 |
| DE | 200 00 633 | U1 | 4/2000 |
| DE | 10 2005 001 877 | A1 | 7/2006 |
| DE | 20 2008 000 302 | U1 | 4/2008 |
| DE | 10 2008 009 234 | A1 | 8/2009 |
| DE | 20 2010 002 820 | U1 | 8/2010 |
| EP | 2 609 834 | A1 | 7/2013 |

OTHER PUBLICATIONS

Form PCT/ISA/210 International Search Report dated Jan. 16, 2013 with English translation of Categories of Documents Cited (5 pages).
Form PCT/ISA/237 Written Opinion of International Searching Authority dated Jan. 16, 2013 (5 pages).
European Search Report of European Patent Office issued in European Application No. 13159324.6-1653 dated Jul. 16, 2013 with English translation of category of cited documents (7 pages).
European Patent Office Search Report dated Mar. 27, 2012 with English translation of Category of Cited Documents (6 pages).

* cited by examiner

SEATING FURNITURE AND FITTING FOR SAME

FIELD OF THE INVENTION

The invention relates to an item of seating furniture, including a base which is fixed in position during the correct use of the item of seating furniture, a seat unit with a seat surface, and a leg unit which is moveable in relation to the seat unit and has a leg support surface. In this case, the leg unit is displaceable by means of a movement mechanism between a storage position, in which the leg unit is arranged under the seat surface, and a use position, in which the leg unit is arranged in front of the seat surface.

BACKGROUND OF THE INVENTION

Diverse variant embodiments of items of seating furniture of the type in question are known from the prior art.

In order to obtain a sufficiently large leg support surface, there are variant embodiments which have a separately moveable end segment next to the leg unit. Provision is generally made in these configurations for the leg unit to be pivotable in relation to the seat unit, sometimes by means of double bracket mechanisms. The leg unit is then generally adjoined by a pivotable end segment. Examples of documents showing such or similar configurations with a leg segment and end segment include BE 100 91 47 A3, DE 10 2008 009 234 A1 and DE 3718645 C2. In the case of configurations which omit an end segment beyond the leg unit, it is more difficult to realize a sufficiently large leg support surface. For this purpose, DE 10 2005 001 877 A1 proposes a mechanism in which the leg unit is changeable in size. The latter can thereby be reduced in size during the transfer from the use position into the storage position below the seat surface. Only in this way is it possible to ensure a sufficient size of the leg support surface in the use position and a sufficient reduction in size of the leg unit in the pivoted storage position.

It is the goal of the invention to develop an item of seating furniture of the type in question to the effect that the latter permits the displacement of the leg unit between the storage position and the use position by means of a simple mechanical configuration, wherein it is desired in particular for the corresponding teaching according to the invention also to be useable in the case of items of seating furniture with less space below the seat unit.

The effect which is preferably intended to be achieved is for an item of seating furniture according to the invention to offer a sufficiently large leg support surface without an end segment which is displaceable in relation to the leg unit having to be arranged next to the latter for this purpose and without the leg unit having to be designed to be changeable in size per se.

According to the invention, this is achieved in that the movement mechanism is designed for transferring the leg unit from the storage position, in which the leg support surface is oriented substantially horizontally, into the use position, in which the leg support surface is likewise oriented substantially horizontally. In order to achieve this, the movement mechanism has an intermediate support which is displaceable in relation to the seat unit or the base by means of a pivoting guide, wherein the pivoting guide has at least one first pivot lever between the intermediate support and the seat unit or the base. Furthermore, an item of seating furniture according to the invention has a sliding guide with a sliding member, wherein the sliding member is guided in a translatory manner on the intermediate support, and wherein the leg unit is attached to the sliding member.

An item of seating furniture according to the invention is preferably an upholstered armchair or an upholstered sofa. In the case of a sofa, the latter may have a plurality of separately moveable leg units.

In conjunction with the detailed description below, the term vertical direction means a direction orthogonal to a deposition surface on which the item of furniture stands. The indication of the transverse direction means a direction of extent which extends horizontally parallel to the front edge of the seat surface. The longitudinal direction of the furniture is a direction which is orthogonal to the transverse direction and vertical direction of the furniture. The indications "at the front" and "at the rear" relate to the longitudinal direction of the furniture and refer to the perspective of the person sitting on the item of furniture and whose legs point forwards and whose back points rearwards.

The particular feature of the item of furniture according to the invention is that the latter is designed to displace the leg support substantially horizontally. A powerful pivoting movement, as is generally provided in the case of configurations from the prior art, is refrained from. At least in the storage position and in the use position, the leg support has the substantial horizontal orientation, which should be understood as meaning that the leg support surface is in each case not pivoted by more than 25° in relation to an imaginary horizontal plane. The leg unit is preferably substantially horizontally oriented in this sense during the entire transfer operation from the storage state into the use state. The abovementioned substantially consistent orientation of the leg unit makes it possible to use a comparatively large leg unit, since the length thereof, unlike in the case of known configurations, does not necessitate a comparatively high seat height on the item of seating furniture. The length of the seat support in the longitudinal direction can thus exceed the height of the clearance below the seat unit. By this means, it is also possible to dispense with an end segment, which is displaceable separately in relation to the leg unit, for extending the leg support surface.

In order to be able to bring about the movement of the leg unit from the storage position into the use position, the movement mechanism of the type explained is provided. Said movement mechanism has an intermediate support which is provided pivotably on the seat unit or the base. The base here is formed by those parts of the item of seating furniture which, during the correct transfer of the item of furniture from the use position into the storage position and vice versa, always remain in a fixed position with respect to an underlying surface on which the item of furniture stands. This is preferably a framework on which the feet of the item of furniture are also provided.

The seat unit can be moveable in relation thereto in the manner which has yet to be explained below. The intermediate support may move along a circular path in relation to the seat unit or the base, in an alternative manner with respect to each other. The intermediate support itself serves for the translatory guidance of a sliding member which is thereby displaceable in the longitudinal direction of the furniture. The leg unit is therefore displaced in relation to the seat unit or the base by two sub mechanisms acting in a cumulatively displacing manner. This achieves the desired extent by which the leg unit should be displaced between the storage position thereof and the use position thereof.

The use of two mechanisms in order jointly to achieve the desired displacement distance results in the two mechanisms, the pivoting guide and the sliding guide, each only having to carry out part of the desired displacement distance. It is therefore preferably possible for even comparatively short levers to be used between the intermediate support, on the one hand, and the base or seat unit, on the other hand. Said levers preferably have a length between the coupling points thereof of not more than 40 cm, preferably of not more than 30 cm.

The sliding guide which permits the movement of the leg unit in relation to the intermediate support preferably permits displacement of the leg unit in relation to the intermediate support of at least 10 cm, preferably of at least 15 cm. Within the context of the invention, a sliding guide should be understood as meaning guidance of the sliding member in relation to the intermediate support, said guidance being realized in particular by a slideway or by guide rollers or else by another guide suitable for producing translatory relative displaceability. The translatory movement is preferably a linear movement.

Depending on the configuration of the item of seating furniture, the displacement of the sliding member in relation to the intermediate support can not only serve to displace the leg unit forwards, but also, in an advantageous manner, permits a pivoting movement of the leg unit in relation to the intermediate support, which pivoting movement is also explained below.

In principle, it is conceivable, with regard to the connection of the intermediate support to the seat unit or the base, for the support as a whole to be fixedly connected to the first pivot lever, and therefore, with regard to the orientation thereof, to follow the pivoting movement. However, it is advantageous if the first pivot lever is coupled to the seat unit or the base so as to be pivotable firstly about a pivot axis and is coupled to the intermediate support so as to be pivotable secondly also about a second pivot axis. This makes it possible to prevent the intermediate support from pivoting to the same extent as is applicable for the pivot lever. Said intermediate support can therefore be displaced by the pivoting guide within the context of a substantially consistent horizontal orientation of the leg unit without substantially having to change its orientation in the process.

In order, nevertheless, to permit a defined displacement of the intermediate support, forced guidance means are preferably provided, by means of which each pivoting position of the first pivot lever in relation to the seat unit or in relation to the base is associated with a resultant pivoting position of the intermediate support in relation to the first pivot lever. Forced guidance means of this type therefore lead to the desired certainty in the intermediate support movement. Said movement is preferably of a type such that, during the transfer of the leg unit from the storage position into the use position, the intermediate support is not pivoted by more than 20°. A configuration of the forced guidance means, in which the pivoting guide has a second pivot lever which is coupled to the seat unit or to the base so as to be pivotable about a third pivot axis spaced apart from the first pivot axis, and also is coupled to the pivoting support so as to be pivotable about a fourth pivot axis spaced apart from the second pivot axis, has proven particularly advantageous. The pivoting guide is therefore designed as a double lever pivoting guide. By the pivot levers having an identical or substantially identical (+/−20%) length between the respective coupling points thereof, the substantially horizontal displacement of the intermediate support is achieved.

The particular feature which arises from the use of the pivoting guide between the base or seat unit, on the one hand, and intermediate support, on the other hand, and from the use of the sliding guide resides in particular in the fact that the predominant portion of the intermediate support can always remain below the seat surface. This applies in particular to the coupling points of the first and optionally also the second pivot lever. Said coupling points are preferably arranged in such a manner that they remain completely to the rear of a front edge of the seat surface irrespective of the position of the intermediate support. The effect therefore achieved is that the intermediate support moves in relation to the seat surface or the base by means of a pivoting guide which can very readily be concealed from the user's sight. This is advantageous in particular if the abovementioned pivot levers are provided on the outside of the seat surface, with reference to the transverse direction. Mechanical components which extend on the left and right from the seat surface as far as in front of the front edge of the seat surface are considered to be aesthetically disadvantageous and furthermore also form considerable opportunities for injury.

It is accordingly considered to be particularly advantageous if only mechanical components of the sliding guide are visible from the outside and from customary perspectives in the use position of the leg unit.

It is in principle conceivable for the sliding guide and the pivoting guide to be mechanically independent such that they can be influenced separately by the user. However, within the context of convenient handling, it is considered to be advantageous if the pivoting guide and the sliding guide are operatively coupled to each other such that, depending on the relative position of the intermediate support in relation to the seat unit or the base, a relative position, which is dependent thereon, of the sliding member with respect to the intermediate support is set.

Provision is accordingly made for the movement of the intermediate support in relation to the seat unit or the base along a path in the shape of a section of a circle indirectly also to cause the movement of the sliding member in relation to the intermediate support. In this case, the movement of the sliding member takes place in a substantially corresponding direction with the movement of the intermediate support. Whereas the intermediate support is therefore displaced forwards to a lesser extent in relation to the base or the seat unit, the leg unit is at the same time displaced forwards to a greater extent.

In order to obtain the abovementioned operative coupling between the pivoting guide and the sliding guide, it has proven particularly advantageous if this is brought about via a control lever which is coupled to the intermediate support, to the sliding member and to the base or the seat unit, or else to one of the pivot levers. In this case, this control lever is preferably mounted on the intermediate support so as to be pivotable about a vertical axis. However, this arrangement with a vertical pivot axis of the control lever results in the coupling points thereof for interaction with the sliding member, on the one hand, and the base, the seat unit or one of the pivot levers, on the other hand, being realized along a circular arc shape, and therefore intermediate levers may be required here. Such a configuration with intermediate levers or a slideway, which is to be provided instead, should also be considered as a coupling within the context of the above explanations with regard to the control lever.

The proposed control lever is pivoted by the relative movement of the intermediate support in relation to the seat unit or the base and transmits said pivoting movement to the sliding guide, as a result of which the sliding member is displaced in relation to the intermediate support.

In principle, it is possible to fasten the leg support to a distal end of the sliding member in such a manner that said leg support is no longer moveable in relation to the sliding member. However, a pivotable coupling of the leg support to the sliding member is of advantage.

This applies in particular to a development of the invention, in which provision is made for an extension which extends as far as the leg support to be attached to the intermediate support. In this case, the leg unit has a pivoting mechanism, wherein said pivoting mechanism is designed for bringing about a pivoting of the leg unit in relation to the sliding member depending on the relative position of the sliding member with respect to the extension.

In this configuration, not only does the sliding member therefore extend as far as the leg support, but so too does an extension, which is part of the intermediate support or is connected fixedly thereto. Since, within the course of the transfer of the leg unit into the use position, a relative displacement of the sliding member in relation to the intermediate support takes place, a displacement of the sliding member in relation to said extension also takes place. According to this development, said relative movement is used in order to pivot the leg unit. This makes it possible to bring about a particularly ergonomic position of the leg unit in the use position. In particular, said pivoting mechanism makes it possible, moreover, to optimize the movement mechanism to the path of movement of the leg unit between the use position and the storage position, since a possible non-ideal orientation of the leg unit in the use position, which orientation arises during said optimization, can be corrected by the additional pivoting mechanism.

Furthermore, the extension can serve to improve the tilting stability of the leg unit.

Since, according to the abovementioned development, both the extension and the sliding member extend between the seat unit and the leg unit and therefore, depending on the configuration of the item of seating furniture, are visible to the user in the use position of the leg unit, it is considered to be particularly advantageous if walls of the extension surround an interior space within which the sliding member is moveably arranged. The user therefore cannot see the presence of two components which are moveable relative to each other. The sliding member is concealed within the extension. In principle, a reverse arrangement is also conceivable, in which the sliding member defines an interior space within which the extension is arranged. In this case, the interior space does not have to be completely closed. However, it is considered to be advantageous within the context of stability if the extension is actually designed as a closed hollow profile within which the sliding member is moveable in a sliding manner or in a manner guided by rollers.

The extension and/or the sliding member are preferably arranged, with reference to a transverse direction of the item of furniture, in a central region which, at maximum, takes up one third of the width of the seat surface. This results in the aesthetically advantageous configuration, in which it is scarcely possible to see anything more than an inconspicuous tube between the seat unit and the leg unit from the outside.

The pivoting mechanism which is assigned to the leg unit preferably has a pivot support which is pivotable about a fifth pivot axis, which is arranged in a fixed position with respect to the sliding member, and is provided in a fixed position with respect to the leg unit. Said pivoting support therefore has the effect that the leg unit is pivotably moveable in relation to the sliding member only about a pivot axis which is fixed in position in relation to the sliding member and leg unit. In order to realize the pivoting movement, provision is preferably made for the pivoting mechanism to have a slotted guide mechanism with a slotted guide track and a slotted guide slider, via which the pivoting support is operatively connected to the extension. A relative movement of the extension in relation to the sliding member therefore results in the desired pivoting displacement of the leg unit in relation to the sliding member. The slotted guide mechanism permits a particularly flexible control here. The effect can thus be achieved, for example, that the pivoting movement of the leg unit in relation to the sliding member takes place only in a final phase during the transfer of the leg unit into the use position. The slotted guide mechanism preferably comprises two slotted guide tracks which are provided in two plates which are parallel to each other and are in turn spaced apart in the transverse direction of the item of furniture. By this means, a high degree of torsional rigidity of the leg unit is obtained. The slotted guide tracks are preferably non-linear.

Furthermore, it is considered to be particularly advantageous if the seat unit is designed so as to be displaceable in relation to the base of the item of seating furniture, as has already been explained at the beginning. In this case, the relative movement of the seat unit in relation to the base is preferably operatively coupled to the relative movement of the pivoting support in relation to the seat unit. The user of the item of seating furniture according to the invention can therefore bring about the transfer of the leg unit from the storage position into the use position by displacement of the seat unit in relation to the base. The displacement of the seat unit forwards in relation to the base preferably results in the leg unit being transferred into the use position.

The item of furniture preferably operates in the manner of a pair of scales. Movement of the seat unit downwards brings about a movement of the leg unit upwards. During the transfer of the leg unit between the use state and the storage position, use is therefore made of the potential energy of the unit being lowered in each case and of the body portion resting thereon in order to raise the other unit and the body portion resting thereon. The user, who remains sitting on the item of furniture, therefore only has to supply a small amount of mechanical energy by muscular force or else by an optionally provided motor for the electrical displacement.

It has turned out to be particularly advantageous if the moveability of the seat unit in relation to the base is provided by two displacement levers which are each coupled to the base and to the seat unit about pivot axes spaced apart from each other. The use of two displacement levers having pivot axes which are parallel to each other but are spaced apart from each other provides a structurally very simple possibility for obtaining the displaceability of the seat unit in relation to the base. The displacement levers are preferably of differing length, and therefore, during the course of the pivoting movement, the seat unit is also tilted. In the use position of the leg unit, a front edge of the seat surface is preferably raised. Provision is preferably made for the pivoting angles of the displacement levers between the base and seat unit always to be smaller than the pivoting angles of the pivot levers between the seat unit and intermediate support. The pivot levers preferably pivot between the storage state and the use state by more than 80° while the displacement levers pivot through less than 60°.

In order to obtain a stable use position and/or a stable storage position of the leg unit, the following measures are expedient: if the leg unit is in the storage position thereof below the seat unit, at least one of the displacement levers or pivot levers is preferably close to a dead centre position or even in a position beyond the dead centre such that, in order to transfer the leg unit into the use position, initially a slight raising of the seat unit at least in the region of said displacement lever in the position beyond the dead centre is required. As an alternative or in addition, an activating lever can be provided, the activating lever making it possible to leave the dead centre position by means of a manually applied muscular force.

This avoids the leg unit being inadvertently transferred into the use position. When the leg unit is in the use position thereof, at least one of the displacement levers, preferably both displacement levers, is or are preferably in a position in which an angle between a connecting straight line, which connects the coupling points of said displacement lever, on the one hand, and a horizontal plane, on the other hand, is preferably <60°, in particular preferably <50°. This results in a shifting of the leg unit from the use position in the direction of the storage position first of all requiring a comparatively powerful application of force to the leg unit, said application customarily not being brought about inadvertently.

It is furthermore considered to be advantageous if a spring device is provided on the item of seating furniture, said spring device in each case putting up a counterforce to a transfer of the leg unit from the use position in the direction of the storage position and/or to a transfer of the leg unit from the storage position in the direction of the use position. This increases the stability of the storage position and of the use position.

In order to obtain the effect of the use position and storage position being stabilized, it is advantageous if the spring device is arranged on subcomponents of the item of seating furniture between coupling points, wherein said coupling points are arranged in such a manner that, during the transfer of the leg support from the storage position into the use position, said coupling points are first of all spaced apart from each other and subsequently are drawn nearer to each other.

Therefore, leaving both the use and the storage position requires the supply of mechanical energy to the spring device.

The invention furthermore relates to a fitting system for items of seating furniture, said fitting system being designed in such a manner that it provides the above-mentioned relative movement between a seat unit, on the one hand, and a constructional unit, on the other hand.

BRIEF DESCRIPTION OF THE DRAWINGS

Further aspects and advantages also emerge, in addition to from the claims, from the description below of a preferred exemplary embodiment of the invention, which is explained with reference to the figures, in which:

DETAILED DESCRIPTION

Figure 1A:
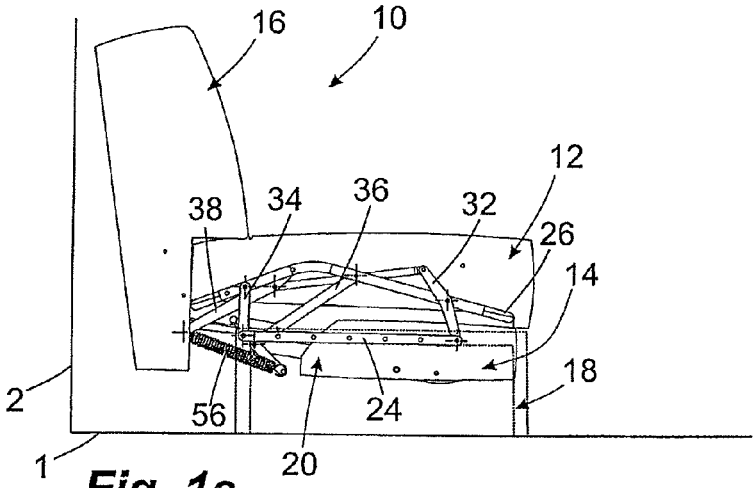
FIGS. 1*a* to 1*c* show an item of seating furniture according to the invention and the fitting thereof when the leg unit is in the storage position thereof.

FIG. 1*a* shows an item of seating furniture 10 according to the invention, which is designed as an upholstered armchair.

Said item of seating furniture 10 has three units which are moveable in relation to one another and are each upholstered, namely a seat unit 12, a leg unit 14 and a backrest unit 16.

The item of seating furniture 10 furthermore has a base framework 18 which forms the base of the item of seating furniture and is illustrated in FIG. 1*a* by means of dotted lines. The base framework 18 is arranged in a fixed position with respect to a floor 1 and a wall 2 located to the rear of the item of seating furniture 10. The item of seating furniture 10 has a movement mechanism 20 which is embodied by the furniture fitting 22 illustrated in FIG. 1*b* and which serves for the purpose of ensuring the relative movement of the seat unit 12 and of the leg unit 14 from the storage position of FIG. 1*a* into the use position of FIG. 3*a*.

Figure 1B:
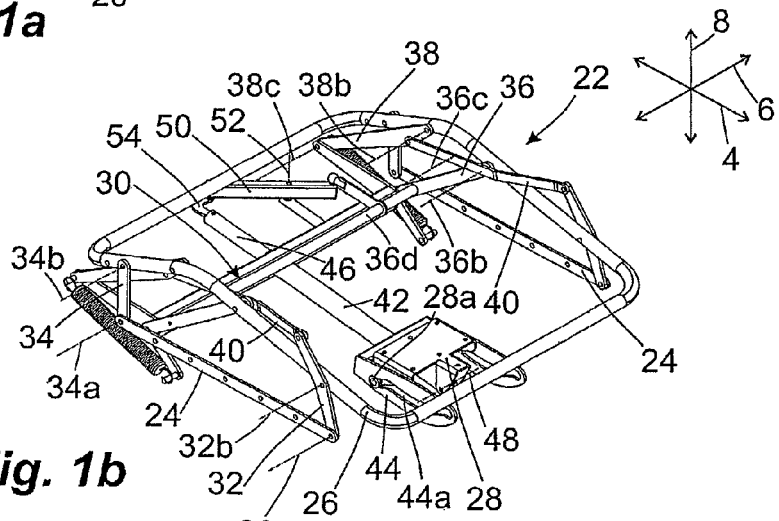

The main components of said furniture fitting 22 are explained below with reference to FIG. 1*b*. The furniture fitting 22 has two attachment strips 24 which are connected fixedly to the base framework 18. The fitting 22 furthermore has a frame 26 which, in the present case, is designed with a closed periphery and serves in a manner not illustrated specifically for the attachment of the seat unit 12 and which is therefore always moved jointly with the seat unit 12. Furthermore, for the attachment of the leg unit 14, the fitting 22 has a pivoting support 28 which always remains in a fixed position with respect to the leg unit 14.

These components are connected to one another as explained below. A number of subsequently mentioned parts of the fitting 22 are in each case provided on the left and right sides of the seat surface and designed for the corresponding movement. Only one of the components is in each case referred to here.

Two displacement levers 32, 34 are provided between the base-mounted attachment strips 24 and the seat-unit-mounted frame 26, said displacement levers each being pivotable about a base-side pivot axis 32*a*, 34*a* and each being pivotable about a frame-mounted pivot axis 32*b*, 34*b*. By this means, the basic moveability of the seat unit 12 in relation to the base framework 18 is provided, wherein, by means of the lever lengths which slightly differ from one another and/or the orientation of the levers in the storage position of FIG. 1*a*, a tilting movement of the seat unit 12 in relation to the base framework 18 is also forced during the course of the movement of said seat unit.

Two pivot levers 36, 38 are provided between the frame 26 and an intermediate support 30 arranged below the frame, wherein said pivot levers are pivotable about pivot axes 36*c*, 38*c* provided in a fixed position with respect to each other on the intermediate support and about pivot axes 36*b*, 38*b* provided in a fixed position on the frame 26. Forced guidance is therefore also provided between the frame 26 and the intermediate support 30. The intermediate support 30 is moveable in relation to the frame 26 only along a movement path predetermined by the pivot levers 36, 38. Since the levers are approximately the same length, the movement takes place with only a slight tilting of the intermediate support 30 in relation to the frame 26.

The relative movement of the frame 26 in relation to the base framework 18 and the relative movement of the intermediate support 30 in relation to the frame 26 are operatively coupled to each other. For this purpose, a coupling lever 40 is provided, said coupling lever being coupled pivotably at one end to an elongation of the displacement lever 32 and at the other end to the pivot lever 38. The result is that the movement of the seat unit 12 in relation to the base framework 18 also forces a movement of the intermediate support 30 in relation to the frame 26. This is also explained below.

Furthermore, an extension 42 which extends forwards from the intermediate support 30 in the direction of a furniture longitudinal axis 4 and is designed over the predominant portion of the length thereof as a hollow tube is formed on the intermediate support 30. The end of said extension 42 is adjoined by a U-shaped end section 44, with a slotted guide track 44*a* being provided in each of the two U limbs thereof designed as sheet metal surfaces. A sliding member 46 is provided within the extension 42, which is designed as a hollow tube, the sliding member being displaceable in the cavity of the hollow tube 42. At the distal end of said sliding member 46, the pivoting support 28 which has already been mentioned is coupled so as to be pivotable about a pivot axis 48. At the sides, said pivoting support 28 has slotted guide sliders 28*a* which extend into the slotted guide tracks 44*a*. A relative displacement of the sliding member 46 in relation to the hollow tube 42 causes the slotted guide blocks 28*a* to be displaced along the slotted guide track 44*a* and, as a result, cause a pivoting movement of the pivoting support 28 in relation to the hollow tube 42 and the sliding member 46.

In order to be able to displace the sliding member 46 within the hollow tube, a control lever 50 is provided. Said control lever is coupled to the intermediate support 30 so as to be pivotable about a pivot axis 52. The two opposite ends of said control lever are connected to a connecting rod 36*d*, which connects the pivot levers 36, and to the sliding member 46 via an intermediate lever 54.

The intermediate lever 54 acts here as an equalizing element and makes it possible, by the control lever 50 pivoting about the pivot axis 52, for the sliding member 46 to be pushed deeper into or to be pulled out from the extension 42, which is designed as a hollow tube.

A movement mechanism which comprises a complete operative coupling between all of the components thereof is therefore provided. The arrangement of all of the other components of the furniture fitting 22 is determined by the relative position of the seat unit 12 in relation to the base framework 18, which relative position is influenced by the user.

Figure 1C:
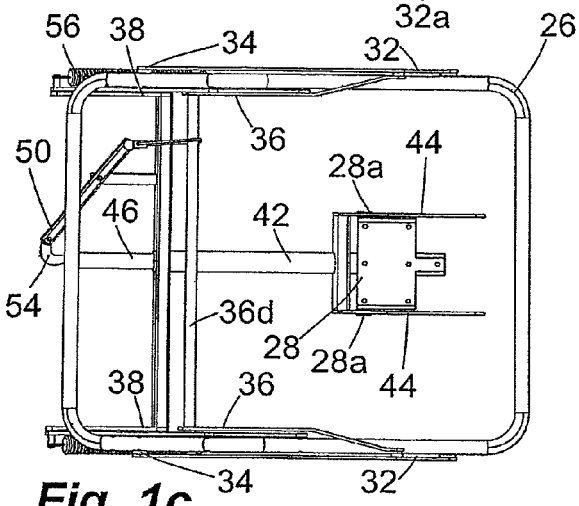
Figure 3A:
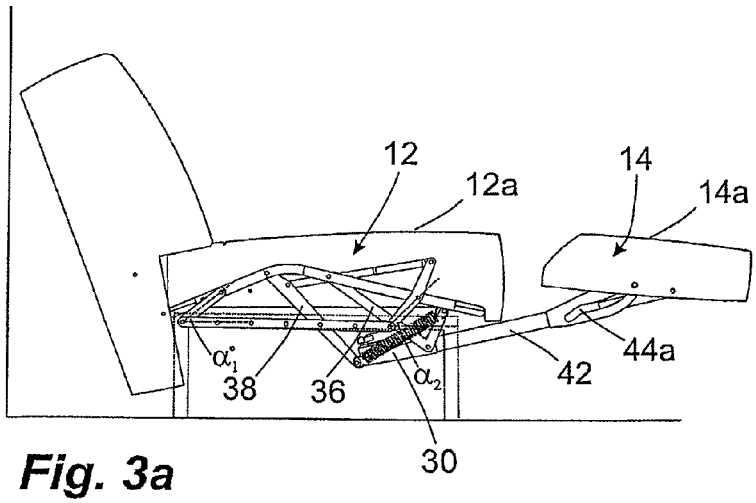
FIGS. 3*a* to 3*c* show the item of furniture and the fitting when the leg unit is in the use position thereof.
Figure 3B:
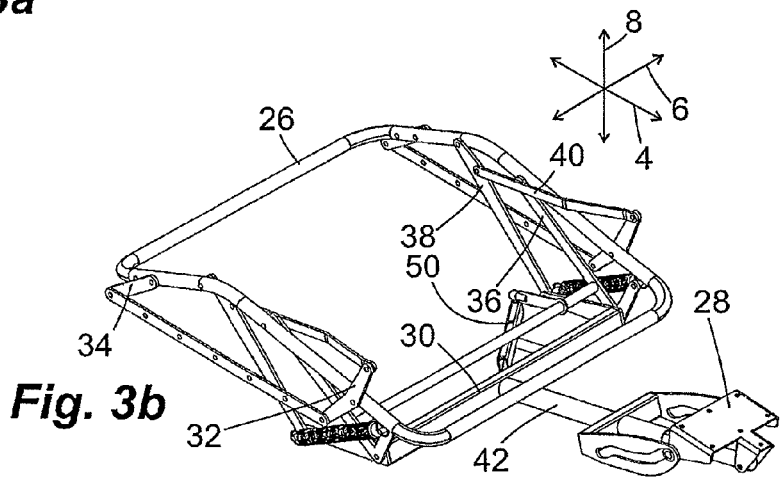
Figure 3C:
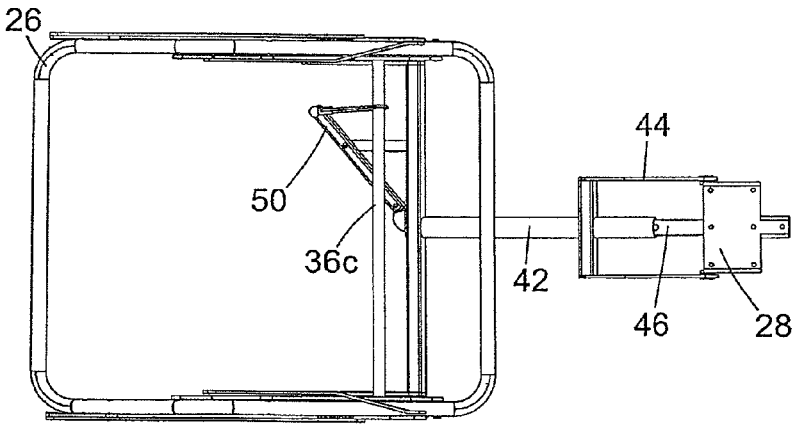

The transfer from the use state of FIGS. 1*a* to 1*c* into the use state of FIGS. 3*a* to 3*c* is explained below according to this explanation of the individual components of the exemplary embodiment of the item of seating furniture according to the invention.

In the starting state of FIGS. 1*a* to 1*c*, in which the leg unit 14 is located below the seat unit 12, the item of furniture has the function and appearance of a simple armchair. In this state, the displacement lever 34 extends substantially vertically such that a rear end of the seat surface 12*a* takes up the highest conceivable position thereof. By contrast, in this starting position, the front displacement lever 32 is in a position beyond the dead centre and is angled in relation to the vertical. In order to displace the leg unit 14, starting from FIG. 1*a*, the front displacement lever 32 has to be pivoted in the clockwise direction with reference to the perspective of FIG. 1*a*. Since this is associated with a raising of a front part of the seat unit 12, on which the weight of the seated person rests, there need be no concern about an inadvertent displacement of the leg unit 14. The stability of the starting position is furthermore reinforced by a spring 56 which is coupled to the pivot levers 36, 38 and which would be extended if the seat unit 12 were displaced in relation to the base framework 18.

In order nevertheless to obtain a transfer of the item of seating furniture 10 into the state of FIG. 3*c*, the user first of all has to overcome the beyond dead centre position of the displacement lever 32. He preferably does this by being supported, for example, on the back unit 16 and displacing the seat unit 12 forwards until the displacement lever 32 is pivoted beyond the vertical. A similar action can also be obtained by an activating lever (not illustrated) which, upon actuation, permits said movement and produces an initial push for the transfer. This can also make it possible in particular to overcome the dead centre position of the coupling lever 40, which position is almost provided in relation to the pivot lever 38 in the starting position.

Figure 2A:
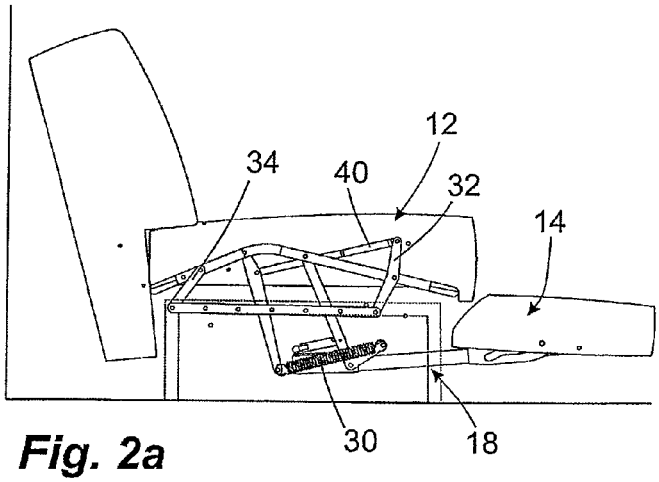
FIGS. 2*a* to 2*c* show the item of furniture and the fitting in a state when the leg unit is in an intermediate position between the storage position and a use position.
Figure 2B:
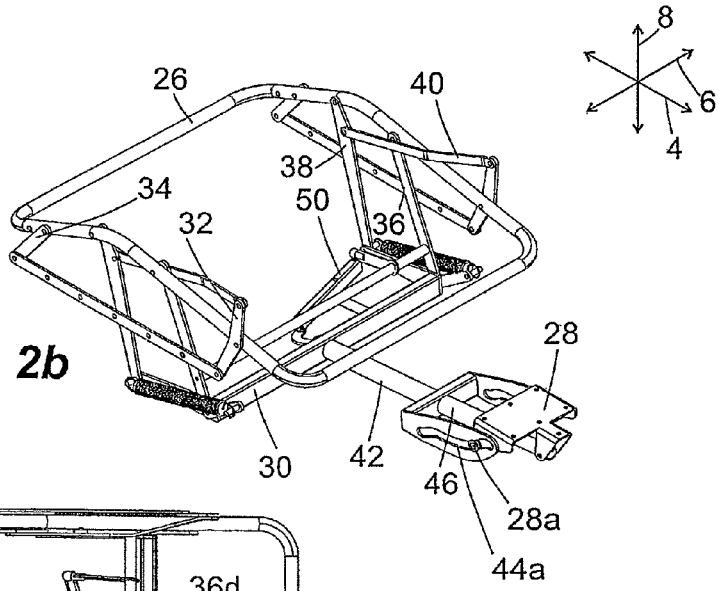
Figure 2C:
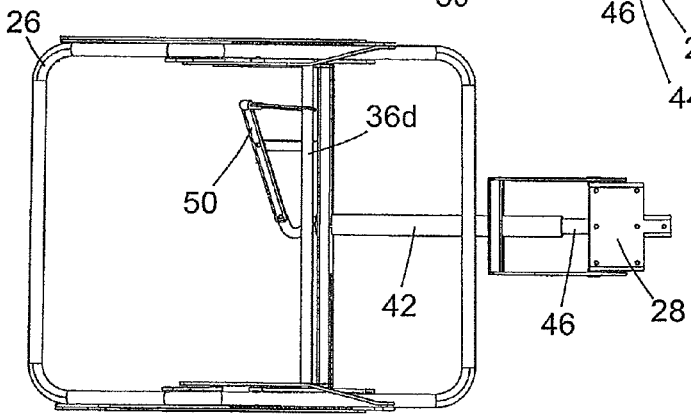

The resultant intermediate state is illustrated in FIG. 2*a*. By means of the coupling of the front displacement lever 32 to the rear pivot lever 38 via the control lever 40, said displacement of the seat unit 12 leads at the same time to a displacement of the leg unit 14 in relation to the seat unit 12. The latter is shifted forwards in a manner substantially free from pivoting and guided primarily by the pivot levers 36, 38. However, the displacement is not restricted to an extent which arises by means of the pivot levers 36, 38 and by which the intermediate support 30 is displaced. Instead, owing to the operative coupling of the sliding member 46 with the intermediate support 30 and the pivot lever 36 via the control lever 50, an additional displacement of the sliding member 46 is also obtained. Said sliding member is pushed deeper into the hollow tube 42 forming the abovementioned extension, wherein said sliding member is moveable in a smooth-running manner in said hollow tube preferably by means of rollers provided for this purpose. At the opposite end, the pivoting support 28 to which the leg unit 40 is fastened is additionally displaced thereby in relation to the base framework 18 in the longitudinal direction 4 of the furniture. Since the sliding blocks 28*a*, which may also be designed as rollers, are thereby displaced in the slotted guide mechanisms 44*a*, a pivoting movement of the pivoting support 28 occurs at the same time.

As the movement continues, the state of FIGS. 3*a* to 3*c* is achieved. By means of the circular path, on which the intermediate support 30 is moved, the leg unit 14 is raised in relation to the seat unit 12 towards the end of the relative movement such that, towards the end of the movement, the leg support surface 14*a* is arranged on the surface of the leg unit 14 approximately level with the seat surface 12*a*. This raising of the leg unit 14 in the final movement phase is also obtained by a slight pivoting of the extension 42 as a consequence of the configuration of the slightly differing lengths of the levers 36, 38, wherein, in order to compensate for said pivoting movement, a corresponding shaping of the slotted guide tracks 44*a* is provided such that, in the manner apparent, the pivoting movement of the leg unit 14 in relation to the floor 1 in the final phase of the movement is negligibly small.

Like the starting position of FIG. 1*a*, the thus obtainable use position of the leg unit 14, which is illustrated in FIG. 3*a*, is very stable. Owing to the angles $\alpha 1$, $\alpha 2$ of the displacement levers 32, 34 of approximately 40° to 45°, which said displacement levers take up in the state of FIG. 3*a*, a transfer of the leg unit 14 back into the state of FIG. 1*a* is first of all associated, in a first movement phase, with the seat unit 12 having to be considerably raised. Since, however, a user is sitting on the seat surface at this time, there need be no concern that the load of the user's legs is sufficient in order to inadvertently cancel the use state of FIG. 3*a*.

Furthermore, the displacement of the seat unit 12 from the starting state of FIG. 1*a* into the position of FIG. 3*a* makes it possible in the sketched manner for the backrest unit 16 to be able to pivot into a comfort position without, in the process, entering into touching contact with the wall 2. This is obtained by the displacement of the seat unit 12.

The invention claimed is:

1. An item of seating furniture, comprising a base which is fixed in position during the use of the item of seating furniture, a seat unit with a seat surface, and a leg unit which is moveable in relation to the seat unit and has a leg support surface, wherein the leg unit is displaceable by means of a movement mechanism between a storage position, in which the leg support surface is arranged under the seat unit, and a use position, in which the leg support surface is arranged in front of the seat unit, wherein the movement mechanism is designed for transferring the leg unit from the storage position, in which the leg support surface is oriented substantially horizontally, into the use position, in which the leg support surface is likewise oriented substantially horizontally, the leg support surface facing in substantially the same direction in each of the use and storage positions, the movement mechanism has an intermediate support which is displaceable in relation to the seat unit or the base by means of a pivoting guide, wherein the pivoting guide has at least one first pivot lever between the intermediate support and the seat unit or the base, and the movement mechanism has a sliding guide with a sliding member, wherein the sliding member is guided in a translatory manner on the intermediate support, and wherein the leg unit is attached to the sliding member.

2. An item of seating furniture according to claim 1, wherein the first pivot lever is coupled to the seat unit or the base so as to be pivotable firstly about a first pivot axis and is coupled to the intermediate support so as to be pivotable secondly about a second pivot axis.

3. An item of seating furniture according to claim 1, wherein a forced guidance arrangement is provided, by which any pivoting position of the first pivot lever in relation to the seat unit or in relation to the base is associated with a resultant pivoting position of the intermediate support in relation to the first pivot lever.

4. An item of seating furniture according to claim 2, wherein the pivoting guide has a second pivot lever which is coupled to the seat unit or to the base so as to be pivotable about a third pivot axis spaced apart from the first pivot axis, and also is coupled to the intermediate support so as to be pivotable about a fourth pivot axis spaced apart from the second pivot axis.

5. An item of seating furniture according to claim 2, wherein the first pivot lever is arranged in such a manner that it remains completely to the rear of a front edge of the seat surface irrespective of the position of the intermediate support, and wherein, the second pivot lever is also arranged in such a manner that it remains completely to the rear of the front edge of the seat surface irrespective of the position of the intermediate support.

6. An item of seating furniture according to claim 1, wherein the pivoting guide and the sliding guide are operatively coupled to each other such that, depending on the relative position of the intermediate support in relation to the seat unit or the base, a relative position, which is dependent thereon, of the sliding member with respect to the intermediate support is set.

7. An item of seating furniture according to claim 1, wherein an extension which extends as far as the leg support is provided on the intermediate support, and a pivoting mechanism is provided on the leg unit, wherein the pivoting mechanism is designed for bringing about pivoting of the leg unit in relation to the sliding member depending on the relative position of the sliding member with respect to the extension.

8. An item of seating furniture according to claim 7, wherein the extension or the sliding member are arranged, with respect to a transverse direction of the item of furniture, in a central region which, at maximum, takes up one third of the width of the seat surface.

9. An item of seating furniture according to claim 7, wherein the pivoting mechanism has a pivoting support which is pivotable about a pivot axis, the pivoting support being coupled to the sliding member and connected immoveably to the leg unit.

10. An item of seating furniture according to claim 9, wherein the pivoting mechanism has a slotted guide mechanism with a slotted guide track and a slotted guide slider, via which the pivoting support is operatively coupled to the extension.

11. An item of seating furniture according to claim 1, wherein the seat unit is designed to be displaceable in relation to the base of the item of seating furniture, wherein the relative movement of the seat unit in relation to the base is operatively coupled to the relative movement of the intermediate support in relation to the seat unit.

12. An item of seating furniture according to claim 11, wherein the moveability of the seat unit in relation to the base is provided by two displacement levers which are each coupled pivotably to the base and to the seat unit.

13. An item of seating furniture according to claim 1, wherein a spring device is provided, said spring device putting up a counterforce to a transfer of the leg unit from the use position in the direction of the storage position or a transfer of the leg unit from the storage position in the direction of the use position.

14. An item of seating furniture according to claim 13, wherein the spring device is arranged on subcomponents of the item of seating furniture between two coupling points, wherein said coupling points are arranged in such a manner that, during the transfer of the leg support from the storage position into the use position, said coupling points are first of all spaced apart from each other and subsequently drawn nearer to each other.

15. A fitting system for an item of seating furniture according to claim 1, comprising a base, a seat unit and a leg unit, which fitting system is designed for displacing the leg unit between a storage position, in which the leg unit is arranged under the seat unit, and a use position, in which the leg unit is arranged in front of the seat unit, wherein the fitting system for this purpose has a movement mechanism which is designed for attaching to the base or the seat unit, on the one hand, and the leg unit, on the other hand, wherein the movement mechanism is designed for transferring the leg unit from the storage position, in which the leg unit is oriented substantially horizontally, into the use position, in which the leg unit is likewise oriented substantially horizontally, the movement mechanism has an intermediate support which is displaceable in relation to a seat-unit-side fastening section or a base-side fastening section by a pivoting guide, wherein the pivoting guide has at least one first pivot lever between the intermediate support and the seat-unit-side fastening section or the base-side fastening section of the base, and the movement mechanism has a sliding guide with a sliding member, wherein the sliding member is guided in a translatory manner on the intermediate support, and wherein a leg-unit-side fastening section is attached to the sliding member.

* * * * *